United States Patent [19]

Stark

[11] 4,399,580

[45] Aug. 23, 1983

[54] TWO PART SHOE BRUSH

[76] Inventor: Robert Stark, 4714 11th Ave., Brooklyn, N.Y. 11219

[21] Appl. No.: 278,626

[22] Filed: Jun. 29, 1981

[51] Int. Cl.[3] ..... A46B 9/10; A46B 15/00

[52] U.S. Cl. ..... 15/107; 15/176

[58] Field of Search ..... 15/107, 106, 114, 118, 15/160, 176, 202

[56] References Cited

U.S. PATENT DOCUMENTS

| | | | |
|---|---|---|---|
| 60,886 | 1/1867 | Hamilton | 15/107 |
| 1,307,060 | 6/1919 | Morrison, Jr. | 15/107 |
| 1,555,630 | 9/1925 | Brock | 15/106 UX |
| 2,254,160 | 8/1941 | Spyckaboer | 15/106 |
| 2,810,147 | 10/1957 | Aman | 15/202 |

FOREIGN PATENT DOCUMENTS

| | | | |
|---|---|---|---|
| 880 | of 1886 | United Kingdom | 15/106 |
| 10902 | of 1899 | United Kingdom | 15/176 |
| 27844 | of 1910 | United Kingdom | 15/176 |

*Primary Examiner*—Peter Feldman

*Attorney, Agent, or Firm*—Goodman & Teitelbaum

[57] ABSTRACT

A combined shoe brush and dauber arrangement having two separate brush sections which matingly assembly to form the shape of a conventional shoe brush configuration. One of the brush sections operates as a dauber. Side hinges are provided for releasably securing the sections together so that they can be selectively disengaged to permit independent usage of at least one of the sections or selectively securely joined together for usage of the dauber and for storage and transport. Confrontingly abutting end surfaces of the two sections are complementary tapered relative to each other.

3 Claims, 4 Drawing Figures

TWO PART SHOE BRUSH

BACKGROUND OF THE INVENTION

This invention relates to a shoe brush, and more particularly to a shoe brush having one part serving as a dauber and another part serving as a conventional shoe brush.

In polishing shoes, it is general procedure to first apply some shoe polish or paste to the shoes using a dauber to rub the paste into the shoe. The dauber usually includes a base member from which extend bristles. After continued use, the dauber generally gets filled with the paste.

After the paste or polish is applied to the shoes, a shoe brush is used to brush the shoes in order to obtain a suitable shine. The brush is usually kept separated and apart from the dauber so that the paste and polish which gets on the dauber will not pass onto the shoe brush itself.

Accordingly, it has been practice to use two separate devices: one as a dauber, and another as a shoe polisher. However, in maintaining the two separate devices, when they are stored or transported, there is a problem of losing one of them since they are separated. Furthermore, because they are separate devices, it becomes clumsy and awkward to store and transport them individually. Also, although they are used independently, when storing them, they are generally placed next to each other and, if they are not properly set in an upright condition, the dauber may fall or lean against the bristles of the shoe brush and accordingly impart some of the paste or polish onto the shoe brush while being stored.

There have been various suggestions in the prior art for combining a shoe brush or polisher together with a dauber. Most of these arrangements use a swivel or swinging apparatus to place the dauber into and out of an operating position with respect to the brush. For example, in U.S. Pat. No. 587,636, the dauber swings from a stored position in which it rests on the head of the brush to an operating position where it is situated beneath the brush. In U.S. Pat. No. 1,166,330, the dauber slides along the upper surface of the brush and moves from an extended operating position to a retracted position, where it is stored in a cutout portion formed in the head of the shoe brush. U.S. Pat. No. 214,419 has yet another arrangement where the dauber is hinged and swings downwardly into operation. Similarly, U.S. Pat. No. 489,694 has a swinging portion where the dauber swings from an overhead to a side angle position for use.

In all of the aforementioned combined daubers and shoe polishers, the shoe brush is utilized while it is still connected to or attached to the dauber which is only moved or swung into and out of an operating position. However, as a result, when using the shoe brush, care must be taken to avoid contacting the dauber. Since in most cases the dauber will have a large amount of wax, paste or polish on it, it becomes very messy and with the dauber in its stored position above or at a side of the shoe brush, extreme care must be taken when using the shoe polisher not to get user's hands filled with the mess from the dauber.

The difficulty with the aforementioned prior art devices is that the dauber is not readily separated from the shoe polisher. Accordingly, because of the awkward positioning of the prior art dauber, storage of the combined shoe brush and dauber becomes difficult. In one embodiment of the prior art, where the dauber is stored in an overhead position, it therefore extends upwardly from the shoe brush and extra care must be taken when storing it so that both the bristles extending downwardly from the shoe brush as well as the bristles extending upwardly from the dauber must be protected. In other embodiments where the dauber extends from a side position, care must also be taken to protect the bristles on the bottom as well as on the sides, and as a result, extra storage room must be provided for the combined shoe brush and dauber.

As a result of the aforedescribed problems, prior art combined daubers and shoe polishers have not been widely accepted and are generally not utilized.

SUMMARY OF THE INVENTION

Accordingly, it is an object of the present invention to provide an improved shoe brush which avoids the aforementioned problems of prior art devices.

Yet another object of the present invention is to provide a combined shoe brush and dauber which avoids the aforementioned problems of prior art combined devices.

Still another object of the present invention is to provide a combined shoe brush and dauber which fit together in an assembled condition so as to form a conventionally shaped shoe brush configuration.

Another object of the present invention is to provide a combined shoe brush and dauber arrangement which facilitates independent usage of the shoe brush, and at the same time permits joining of the two items for storage, transportation and for usage of the dauber.

Yet another object of the present invention is to provide a combined shoe brush and dauber whereby all of the bristles, both from the dauber and from the shoe brush, extend in the same direction, thereby facilitating storage and protection of the bristles during storage and transport.

Still another object of the present invention is to provide a combined brush and dauber arrangement which permits easy disengaging of the dauber from the shoe brush to facilitate independent utilization of the shoe brush, and at the same time provides for selective rejoining of the dauber to the shoe polisher for utilization of the dauber, as well as for storage and transport.

Briefly, in accordance with the present invention, there is provided a combined shoe brush and dauber arrangement having two brush sections which are matingly assemblable to form a composite which has the shape of a conventional shoe brush configuration. One of the brush sections operates as the dauber, particularly the smaller section. A coupling arrangement is associated with the two sections for releasably securing the sections together. In this manner, the sections can be selectively disengaged in order to permit independent usage of at least one of the sections, particularly the larger section which defines the shoe brush. The sections can be selectively joined together for storage and transport in addition to the utilization of the dauber, wherein the shoe brush section functions as a handle.

In an embodiment of the present invention, each section comprises a base member with bristles depending therefrom. The respective medial end surfaces of the two base members are tapered and confrontingly abut each other in the assembled condition to form a composite base member. A bracket having a slot in its distal end extends from each side of one base member and spans across to the other base member. A hook associated with each side of the other base member engages its associated slot and holds the two sections together. A cut out beneath one of the hooks permits deflection of the hook to disengage the hook from its associated slot thereby permitting removal of the other hook from its slot to disengage the two sections.

The aforementioned objects, features and advantages of the present invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the drawing.

In the various figures of the drawing, like reference characters designate like parts.

DESCRIPTION OF THE PREFERRED EMBODIMENTS

Figure 1:
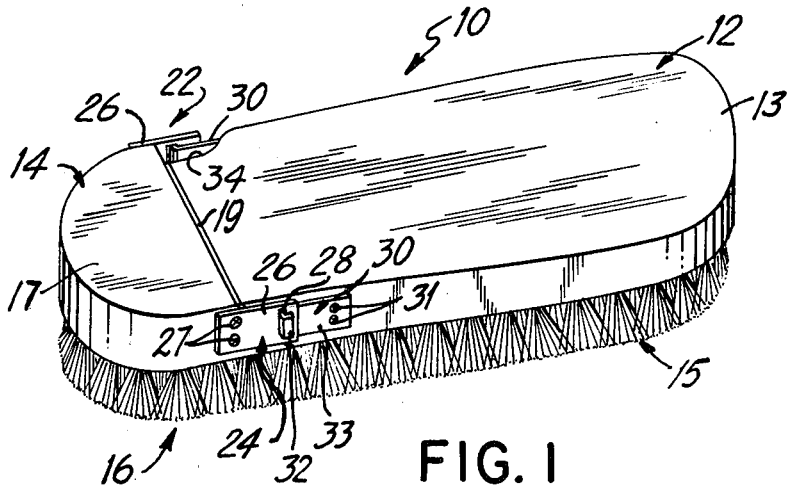
FIG. 1 is a perspective view showing the combined shoe brush and dauber in an assembled condition according to the present invention.

Referring now to the drawings, the present invention is directed to a combined shoe brush and dauber which is shown generally at 10. The arrangement is formed of a larger section shown generally at 12 and a smaller section shown generally at 14. The larger sections 12 is utilized as the shoe brush and the smaller section 14 is utilized as the dauber. It should be noted, as can be seen in FIG. 1, that in the combined assembled condition, the two sections join together to form the shape of a conventional shoe brush configuration. However, the two sections each operate independently to perform their respective different functions.

The shoe brush section 12 includes a base member 13 from which depend bristles 15. The dauber section 14 also includes bristles 16 which depend from a base member 17. The medial facing ends of the two base members 13, 17 form mating ends 18, 20 which abut each other in a confronting arrangement during the assembled condition. The mating ends or faces 18, 20 are tapered in complementary fashion whereby the mating face 18 has its upper edge extending forward onto the face 20, and its lower edge extending away from the dauber 14. The correspondingly confronting mating face 20 complements the taper of face 18 so that its upper end is further distant from the shoe brush 12 and its lower edge is closer to the shoe brush 12.

A cushioning member 19 is placed between the confronting end faces 18, 20. The cushioning is shown as being adhered to the end face 18. However, it could likewise be adhered onto the end face 20.

The two sections 12, 14 are joined together by means of the hinges 22, 24 which are respectively disposed on the opposing sides of the base members 13, 17 in order to secure the two sections 12, 14 together. Each of the hinges 22, 24 include a bracket 26 which is fastened onto an opposing side wall of the base member 17 by means of conventional screws 27. The brackets extend along the side wall of the base member 17 and continue across the edge of the confronting end face 20 so that in the assembled condition it will overlie the side wall of the adjacent section 12 of the shoe brush. A transverse slot 28 is formed in the distal free end of each of the brackets 26.

On opposing sides of the base member 13 of the shoe brush section 12, there are placed hook members 30 which are securely fastened onto the side wall by means of conventional screws 31. Each of the hook members 30 includes a longitudinally extending section 33 which abuts against the side wall of the base member 13 and a hooked end 32, 32' which extends away from the side wall. It should be noted that the hooked end 32 extends more rearwardly than the hooked end 32' which is almost perpendicular to its lateral section 33 and hardly extends rearwardly at all. Each of the hooked ends 32, 32' engages in a respective slot 28 in the bracket 26 adjacent thereto. Additionally, adjacent to the hooked end 32' there is provided a cutaway portion 34 in the side wall of the base member 13 beneath the hooked member 30, the function of which is set forth below.

Figure 2:
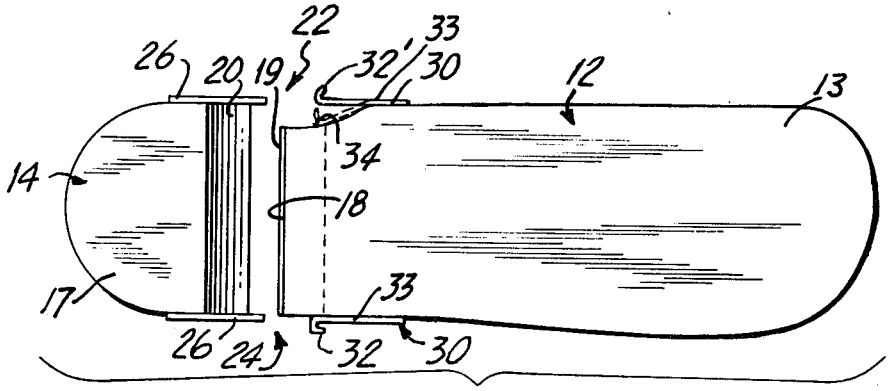
FIG. 2 is a plan view showing the shoe brush and dauber in a disengaged condition.
Figure 3:
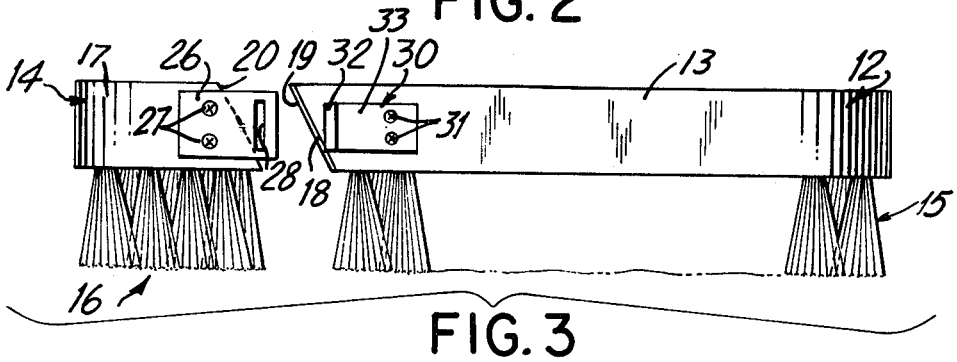
FIG. 3 is a side elevational view of the disengaged parts of FIG. 2.
Figure 4:
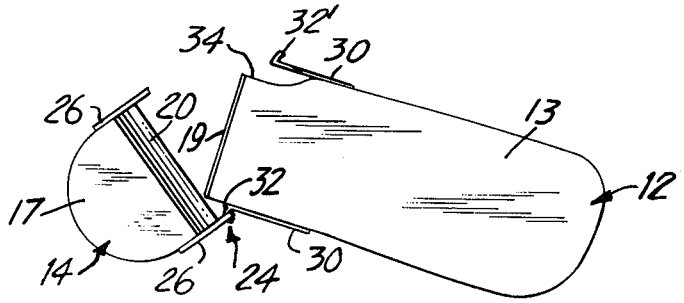
FIG. 4 is a plan view showing an intermediate step in the coupling and uncoupling of the two sections.

In order to separate the two sections 12, 14 the hook member 30 of hinge 22 adjacent to the cutaway portion 34 is deflected into the cutaway portion 34, as indicated in broken lines in FIG. 2, to disengage its hook end 32' from its respective slot 28. The two sections 12, 14 are then pivoted away from each other, as shown in FIG. 4. The other hinge 24 can then be disengaged by removing the hook end 32 from its slot 28. The two sections 12, 14 are then completely disengaged from each other so that the section 12 can be operated and utilized independently of the section 14 as set forth below.

To join the sections together, the above procedure is reversed. Specifically, with the two sections angled with respect to each other, as shown in FIG. 4, the hook 32 of the hinge 24 is inserted into its respective slot 28. The two sections 12, 14 are then placed coaxially with each other, and the hooked member 30 of hinge 22 is deflected into the cutaway portion 34 and then released whereupon the hook end 32' will engage into its slot 28.

When the two section are joined together, the smaller section 14 is used as a dauber in order to apply polish to the shoes, whereby the section 12 functions as a handle. The two sections are then separated so that the larger section 12 can then be used to brush the shoes and shine them, without any possibility of getting polish on the shined shoes. After brushing the shoes, the two sections can be joined together for storage or transportation. Once they are joined, it should be noted that all of the bristles face in the same direction. As a result, it is only necessary to protect one surface of the combined device and no extra care must be taken to protect the sides or top of the unit since no bristles extend from any other direction but from the bottom thereof.

As noted above, during use of the shoe brush, it is not necessary to be extra cautious in order to avoid the paste from the dauber from getting onto the shined shoes since the dauber is separated and removed from the shoe brushing section 12 so that the shoe brushing section 12 can be operated independently. It should further be noted, that in the assembled condition, the two parts join together to form the configuration of a conventional shoe brush. As a result, the two parts can be stored in the same area where normally the shoe brush itself could be stored, and no separate storage compartment need be provided for the dauber by itself.

By tapering the two abutting surfaces 18, 20, the side hinges 22, 24 can be utilized without having the two sections 12, 14 fall apart. The tapering in conjunction with the side hinges provides for a secure engagement of the two sections. At the same time, the use of the side hinges will facilitate separating of the two sections for independent usage of the shoe brushing section 12.

There has been disclosed heretofore the best embodiment of the invention presently contemplated. However, it is to be understood that various changes and modifications may be made thereto without departing from the spirit of the invention.

What is claimed is:

1. A combined brush and dauber arrangement comprising:

first and second brush sections which matingly assemble to provide a composite conventional shoe brush configuration, one of said brush sections operatively defining a dauber;

first and second coupling means associated with said first and second brush sections for releasably securing said brush sections together so that said sections can be selectively disengaged to permit independent usage of at least one of said brush sections, and so that said brush sections can be selectively rejoined for usage of said dauber and for storage;

said first and second brush sections including respectively first and second base members with bristles depending therefrom, respective medial end surfaces of said first and second members confrontingly abutting each other in an assembled condition;

said first and second coupling means being positioned on opposite sides of said brush sections, each of said coupling means straddling across its respective base members of said first and second brush sections;

said first and second coupling means including respectively first and second brackets coupled to opposite sides of said first base member and extending cantileverly therefrom across to associated opposite sides of said second base member, and first and second grasping means on said opposite sides of said second base member for securing respectively onto said first and second brackets;

each of said first and second brackets including a transverse slot in a distal free end, said first and second grasping means including first and second hook members coupled to the opposite sides of said second base member for hooking respectively in said slots to lock said brush sections together;

each of said hook members being a strip of material having a bend at one end to define a hook, and being provided with a width approximately equal to the length of its associated transverse bracket slot;

said first bracket and said first hook member being disposed on adjacent sides of said base members, said first bracket and said first hook member engaging together to provide hinge means for pivoting opposite adjacent sides of said base members together so that said medial end surfaces of said first and second base members confrontingly abut with each other;

said second hook member being resilient and being cantileverly disposed over a cutaway portion in said second base member, said cutaway portion extending from said medial end surface of said second base member to the opposite side of said second base member adjacent said second hook member to provide clearance means to permit deflection of said second hook member therein for engagement and disengagement of said second hook member in said slot of said second bracket when said first bracket and said first hook member are engaged; and said confrontingly abutting medial end surfaces of said first and second base members being complementary tapered relative to each other to prevent relative longitudinal and transverse movement between said base members in the assembled condition.

2. A combined brush and dauber arrangement as in claim 1, wherein the confronting end surface of said dauber is outwardly tapered in a downward direction towards said bristles depending therefrom.

3. A combined brush and dauber arrangement as in claim 1, and further including cushioning means disposed between said confronting end surfaces.

* * * * *